US006968620B2

(12) United States Patent
Okabe

(10) Patent No.: US 6,968,620 B2
(45) Date of Patent: Nov. 29, 2005

(54) ELECTRIC SHAVER

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/691,845

(22) Filed: Oct. 23, 2003

(65) Prior Publication Data

US 2004/0078978 A1 Apr. 29, 2004

(30) Foreign Application Priority Data

Oct. 24, 2002 (JP) ..... 2002-309275

(51) Int. Cl.[7] ..... B26B 19/14
(52) U.S. Cl. ..... 30/43.6; 30/346.51
(58) Field of Search ..... 30/43.6, 206, 43.5, 30/346.51

(56) References Cited

U.S. PATENT DOCUMENTS 3,119,180 A * 1/1964 Bruecker ..... 30/43.6
4,038,748 A * 8/1977 Tyler ..... 30/43.6
4,393,586 A 7/1983 Hamashima et al.
6,145,200 A * 11/2000 Jorna et al. ..... 30/43.6
2002/0062565 A1 * 5/2002 Uchiyama et al. ..... 30/43.6

FOREIGN PATENT DOCUMENTS

| | | |
|---|---|---|
| EP | 0 566 234 | 10/1993 |
| EP | 0 652 086 | 5/1995 |
| GB | 1 417 812 | 12/1975 |
| JP | 7-185149 | 7/1995 |
| JP | 11-4980 | 1/1999 |

* cited by examiner

*Primary Examiner*—Douglas D Watts
(74) *Attorney, Agent, or Firm*—Koda & Androlia

(57) ABSTRACT

An electric shaver including an outer cutter, which has a ring-shaped shaving surface that contacts the skin and an outer cutter surface that is formed on its inside surface, and an inner cutter, which has an inner cutter surface that makes sliding contact with the outer cutter surface, the outer and inner cutters being tiltably disposed with respect to a cutter frame disposed on a head portion of the shaver main body; wherein the inner cutter surface has a convex shape, the outer cutter surface has a concave shape that receives therein the convex inner cutter surface, and the convex inner cutter surface of the inner cutter is engaged with the concave outer cutter surface, thus preventing axial deviation of the inner cutter during the rotation.

8 Claims, 7 Drawing Sheets

ELECTRIC SHAVER

BACKGROUND OF THE INVENTION

1. Field of the Invention

The present invention relates to an electric shaver and more particularly to a rotary type electric shaver that cuts whiskers by means of an inner cutter that rotates along an outer cutter.

2. Prior Art

FIG. 6 shows a conventional electric shaver, and it particularly shows the structure of the outer cutter and the inner cutter that makes sliding contact with the outer cutter disclosed in, for instance, Japanese Patent Application Laid-Open (Kokai) No. 11-4980.

In this structure, the outer cutter 102 has an outer surface that contacts the skin during shaving. The outer surface is a ring shaped shaving surface 103. The surface that makes sliding contact with a cutter body 107 of the inner cutter 106 on the inner surface of the outer cutter 102 makes an outer cutter surface 104. A plurality of cutter bodies 107 that make sliding contact with the outer cutter surface 104 are provided on the inner cutter 106. Each of the tip end surfaces of the cutter bodies 107 makes an inner cutter surface 108. The outer cutter surface 104 is in a planar shape (or is flat), and the inner cutter surface 108 that makes sliding contact with the outer cutter surface 104 is likewise in a planar shape (or is flat).

The inner cutter 106 is connected to an inner cutter drive shaft 109 via an inner cutter supporting body 118 and is rotationally driven by the inner cutter drive shaft 109. The inner cutter supporting body 118 that engages with a tip end of the inner cutter drive shaft 109 is disposed so as to be tiltable in any desired direction with respect to the inner cutter drive shaft 109.

The inner cutter drive shaft 109 is disposed so that the inner cutter 106 is constantly urged by a biasing means (not shown in the drawings) in the direction that causes this inner cutter 106 to be pressed against the outer cutter 102, i.e., in the outward direction (or upward direction in FIG. 6). As a result of the urging force of the inner cutter drive shaft 109, the flange 102*a* of the outer cutter 102 contacts the inner wall surface of a cutter frame 28 via the inner cutter 106 so that the outer cutter 102 tilts with respect to the cutter frame 28. The inner cutter 106 that makes sliding contact with the outer cutter surface of the outer cutter 102 is provided so that the inner cutter 106 tilts in accordance with the outer cutter 102.

The area surrounded by the ring-shaped shaving surface 103 of the outer cutter 102 is a recessed portion 112. An outer cutter cover 116 is fitted into this recessed portion 112 so that the outer cutter cover 116 is set in the center of the ring-shaped shaving surface 103. The outer cutter cover 116 is fastened in place by inserting the engaging wall 116*a* of the outer cutter cover 116 into the engaging hole 112*a* formed in the recessed portion 112 of the outer cutter 102. The engaging wall 116*a* is in a cylinder shape that opens at the bottom on the inner cutter supporting body 118 side of the outer cutter cover 116. A recess 116*b* is formed in the engaging wall 116*a* and is positioned in the center of the outer cutter 102, and a guide portion 118*c* which protrudes from the projecting portion 118*a* of the inner cutter supporting body 118 is inserted into this recess 116*b*.

The guide portion 118*c* of the rotating inner cutter supporting body 118 is supported coaxially with the outer cutter 102 as a result of the outside surface of the guide portion 118*c* constantly contacting with the inside surface of the recess 116*b* of the outer cutter cover 116. As a result, the outer cutter 102 and the inner cutter supporting body 118 that supports the inner cutter 106 are kept coaxial; and even when the outer cutter 102 tilts, axial deviation between the outer cutter 102 and the inner cutter supporting body 118 is prevented.

Another conventional outer and inner cutter structure of an electric shaver is shown in FIG. 7 as disclosed in, for example, Japanese Patent Application Laid-Open (Kokai) No. 7-185149.

In this electric shaver as well, the outer cutter 120 and the inner cutter 124 are provided so that these cutters tilt with respect to the cutter frame 123, and the outer cutter surface 128 and inner cutter surface 130 are formed in a planar shape (or they are flat). Unlike the electric shaver shown in FIG. 6, a bearing portion that guides an inner cutter supporting body coaxially with the outer cutter is not provided in the shaver of FIG. 7. Instead, the inside region 122 of the shaving surface 121 of the outer cutter 120 is simply recessed and has a flat bottom. Furthermore, the upper end surface 126*a* of the inner cutter supporting body 126 that supports the inner cutter 124 is formed flat, and the under-surface of the recessed portion 122 and the upper end surface 126*a* of the inner cutter supporting body 126 are disposed so as to be spaced apart from each other.

In this electric shaver, a guide surface 132 is formed on the inner surface of the outer cutter 120 so that the inside surface 136 of the cutter body 125 of the inner cutter 124 makes sliding contact with this guide surface 132. The cutter body 125 of the inner cutter 124 is guided by the guide surface 132 so that the inner cutter 124 rotates without making any axial deviation with respect to the outer cutter 120. Since the inner cutter surface 130 of the inner cutter 124 is constantly pressed against the outer cutter 120, the inner cutter 124 conforms to the outer cutter 120 when the outer cutter 120 tilts, so that the inner cutter 124 rotates without any axial deviation.

However, in the electric shaver shown in FIG. 6, when the inner cutter 106 rotates, a load is applied to the driving force that rotates the inner cutter supporting body 118 as a result of the friction that generates between the inside surface of the recess 116*b* of the outer cutter cover 116 and the outside surface of the guide portion 118*c* of the inner cutter supporting body 118, and as a result, the electric power consumed by the electric shaver increases. Furthermore, the recess 116*b* of the outer cutter cover 116 and the guide portion 118*c* of the inner cutter supporting body 118 need to be manufactured precisely in order to prevent axial deviation of the inner cutter 106.

Furthermore, in the electric shaver shown in FIG. 7, friction occurs by the sliding contact of the side surface 136 of the rotating inner cutter 124 with the guide surface 132 of the outer cutter 120, so that the electric power consumption increases by this frictional force as in the case of the electric shaver of FIG. 6. The electric shaver of FIG. 7 has further problems. Since the side surface 136 of the cutter body 125 and the guide surface 132 of the outer cutter 120 constantly make sliding contact, the side surface 136 of the cutter body 125 can easily wear out, deteriorating the function to prevent axial deviation.

SUMMARY OF THE INVENTION

The present invention solves the problems describe above.

The object of the present invention is to provide an electric shaver in which the inner cutter rotates without any axial deviation with respect to the outer cutter, thus consuming smaller electric power than in a conventional electric shaver.

The above object is accomplished by a unique structure of the present invention for an electric shaver that includes:

an outer cutter in which the shaving surface that contacts the skin is formed in a ring shape and the inside surface of this shaving surface is formed as an outer cutter surface, and an inner cutter in which a portion that makes sliding contact with the outer cutter surface is formed as an inner cutter surface, the inner cutter being connected to an inner cutter drive shaft so that the inner cutter is rotated thereby, and the outer cutter and the inner cutter are tiltably disposed with respect to a cutter frame that is provided on the electric shaver main body; and in the present invention, the inner cutter surface is formed as a convex surface that protrudes toward the outer cutter side from the inner cutter side, the outer cutter surface is formed as a concave surface that receives the convex inner cutter surface, and the inner cutter surface and the outer cutter surface are engaged with each other so as to prevent axial deviation of the inner cutter.

In this structure, the outer cutter and the inner cutter are disposed so that these cutters are spaced apart from each other except for portions that make sliding contact between the outer cutter surface and the inner cutter surface.

In addition, the inner cutter surface is formed as a convex curved surface.

Furthermore, in the present invention an outer cutter guide surface whose shape in cross section in the direction of diameter of the outer cutter is rectilinear can be formed on at least a part of the outer cutter surface, and an inner cutter guide surface which makes sliding contact with this outer cutter guide surface is formed on the inner cutter surface.

The outer cutter guide surface has an angle of inclination $\theta$ which is substantially $30° < \theta < 90°$ with respect to a plane of rotation of the inner cutter.

Furthermore, one or a plurality of concentric circular demarcating grooves can be formed in the outer cutter, and the inner cutter surface is formed in a shape that engages with the outer cutter surface demarcated by such demarcating grooves.

DETAILED DESCRIPTION OF THE INVENTION

Preferred embodiments of the electric shaver of the present invention will be described in detail below with reference to the accompanying drawings.

The internal mechanism of the electric shaver 10 for the structure of FIG. 1 will be first described below with reference to FIG. 2.

Figure 2:
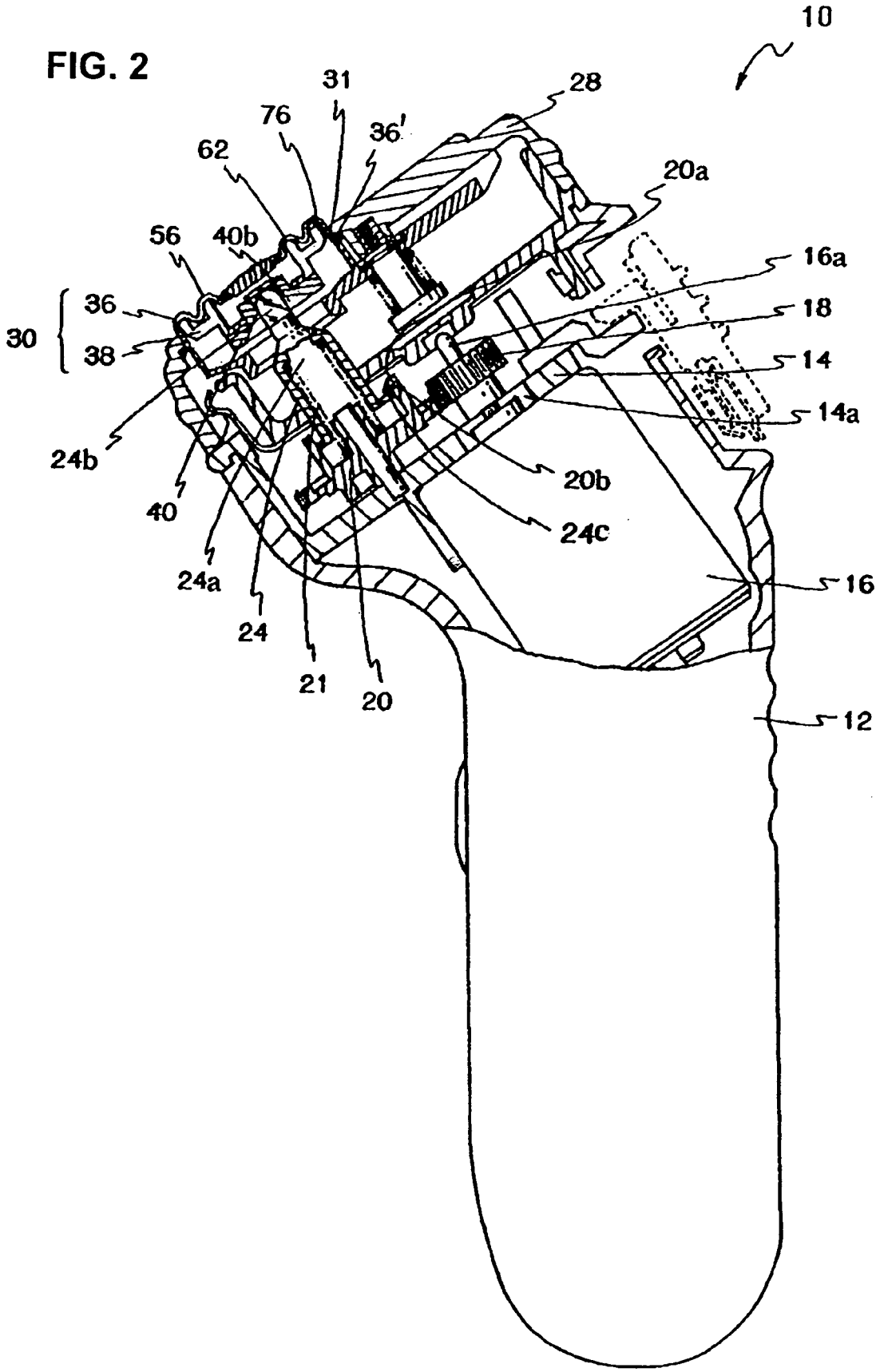
FIG. 2 is a sectional diagram of the head portion of the electric shaver according to one embodiment of the present invention.

In FIG. 2, a fastening frame 14 is attached to the interior of the main body 12 of the shaver 10. A motor 16 is fastened to the undersurface of the fastening frame 14. The drive shaft 16*a* of this motor 16 protrudes from a hole 14*a* of the fastening frame 14, and a drive gear 18 is attached to the drive shaft 16*a*. Three transmission gears 20 (only one of them shown) which are supported on the fastening frame 14 are disposed so as to engage with the drive gear 18. These three transmission gears 20 are disposed so that they are positioned at the vertices of an (imaginary) equilateral triangle.

The three transmission gears 20 have the same structure; and therefore, the structure of one transmission gear 20 will be described below.

An inner cutter drive shaft 24 is engaged with the transmission gear 20. The upper portion of the inner cutter drive shaft 24 is an engagement tip end 24*b*, and the portion extending from the trunk portion of the inner cutter drive shaft 24 to the lower portion is formed in a hollow tubular shape. A spring 21 is installed inside the tubular body 24*a* of the inner cutter drive shaft 24 as a biasing means, so that the inner cutter drive shaft 24 is urged outward.

A flange 24*c* formed on the edge of the opening at the lower end of the inner cutter drive shaft 24 is positioned inside a guide tube 20*a* disposed on a transmission gear 20 and is prevented from slipping out of the guide tube 20*a* by a claw 20*b* that is formed on the inside wall surface of the guide tube 20*a*. The flange 24*c* of the inner cutter drive shaft 24 and the guide tube 20*a* are engaged with each other, and this transmission gear 20 and the inner cutter drive shat 24 are rotationally driven together as a unit. The inner cutter drive shaft 24 is rotatable in a state in which the drive shaft 24 is tilted with respect to the axial direction of the transmission gear 20.

A cutter frame 28 is detachably attached to the upper portion of the main body 12 of the shaver 10. Three cutter holes 31 are formed in the upper surface of this cutter frame 28 (only one cutter hole 31 is shown in FIG. 2), and shaving units 30 each comprising an outer cutter 36 and an inner cutter 38 are respectively provide in these cutter holes 31 from the inside.

Figure 1:
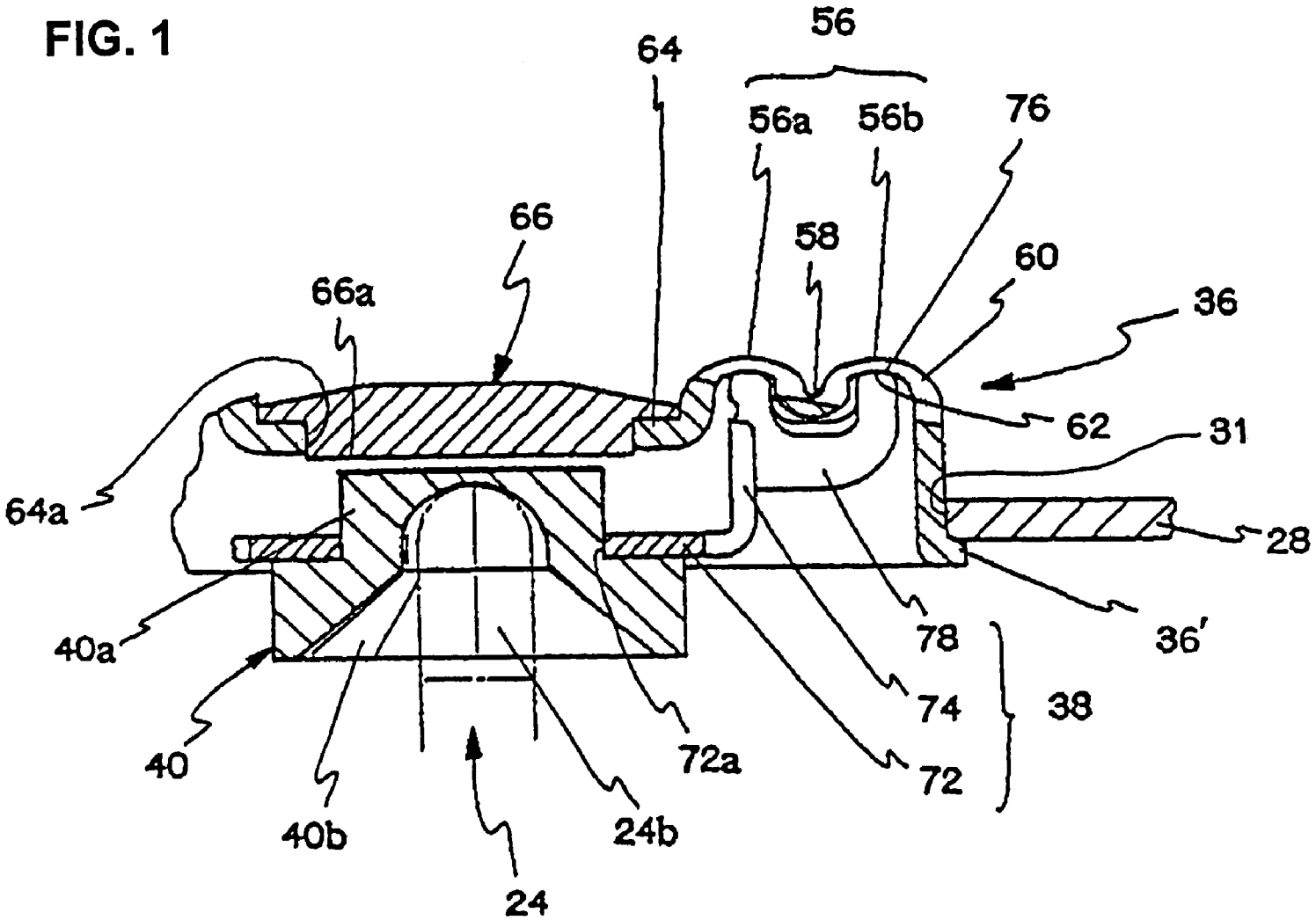
FIG. 1 shows in cross section the structure of the main portion of the outer cutter and inner cutter of the electric shaver of the present invention.

As seen from FIG. 1, the inner cutter 38 of each shaving unit 30 is connected to the corresponding inner cutter drive shaft 24 via an inner cutter supporting body 40 and is rotationally driven by the inner cutter drive shaft 24. The engagement tip end 24*b* of the inner cutter drive shaft 24 is flat, and its tip end has a curved shape that protrudes outward (upward in FIG. 1). A recess 40*b* is formed on the undersurface side of the inner cutter supporting body 40. The recess 40*b* is formed in the shape of a groove into which the engagement tip end 24*b* of the inner cutter drive shaft 24 is inserted with a slight gap in between. The inner surface of the recess 40*b* contacted with the tip end of the engagement tip end 24*b* has a curved surface that is substantially the same shape as the tip end of the engagement tip end 24*b* of the inner cutter drive shaft 24.

With the arrangement above, the inner cutter supporting body 40 that engages with the engagement tip end 24*b* of the inner cutter drive shaft 24 can tilt in one direction along the outwardly curved shape of the engagement tip end 24*b* and also can tilt in another direction perpendicular to this one direction as a result of the above-described engagement gap between the recess 40*b* and the engagement tip end 24*b*.

The outer cutter 36 is pushed outward (upward in FIG. 1) by the driving force of the inner cutter drive shaft 24 and is supported so that the shaving surface 56 protrudes from the cutter hole 31 of the cutter frame 28. The outer cutter 36 is supported in a tiltable fashion with respect to the cutter frame 28, and the inner cutter 38 tilts in conformity with the outer cutter 36.

A flange 36' is formed on the lower end of the outer cutter 36, and it contacts the inside surface (or the under surface) of the cutter frame 28; as a result, the outer cutter 36 is prevented from slipping out of the cutter hole 31 of the cutter frame 28. The outer cutter 36 is in contact with the cutter frame 28 but is prevented from making rotation by a stopper (not shown in the drawings).

The electric shaver 10 of the present invention is equipped with a mechanism that prevents axial deviation of each inner cutter 38 with respect to the corresponding outer cutter 36.

More specifically, in the present invention a deviation of the central axis of the rotating inner cutter 38 from the center of the outer cutter 36 is prevented, and the inner cutter surface 76 constantly rotates making sliding contact with the outer cutter surface 62. The shapes and conditions that bring the sliding contact of the inner cutter 38 with the outer cutter 36 without deviation of the central axis of the rotating inner cutter 38 from the center of the outer cutter 36 will be described in detail below.

Figure 3A:
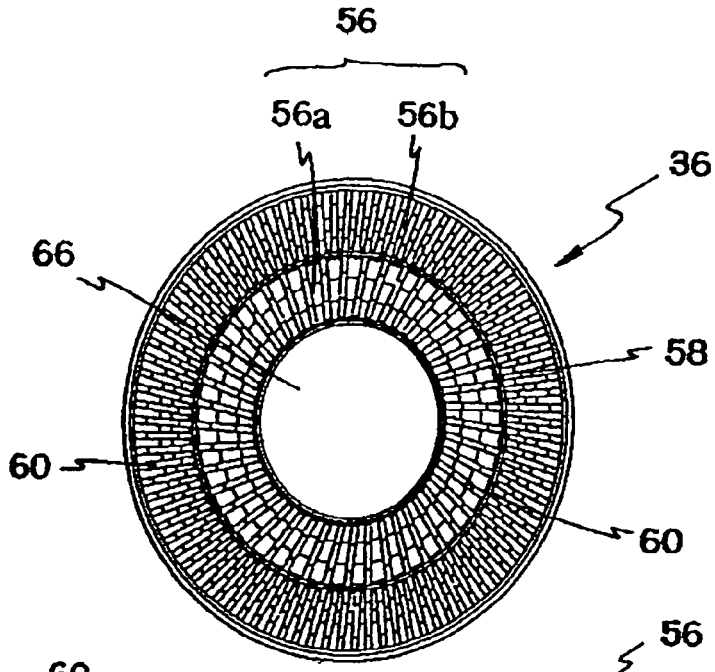
FIG. 3(*a*) is a top view of the outer cutter of the electric shaver of the embodiment of the present invention, FIG. 3(*b*) is a front view thereof and FIG. 3(*c*) is a bottom view thereof.
Figure 3B:
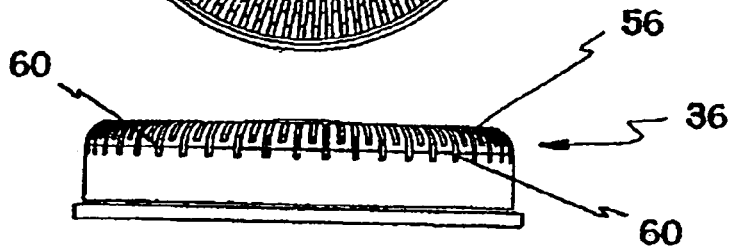
Figure 3C:
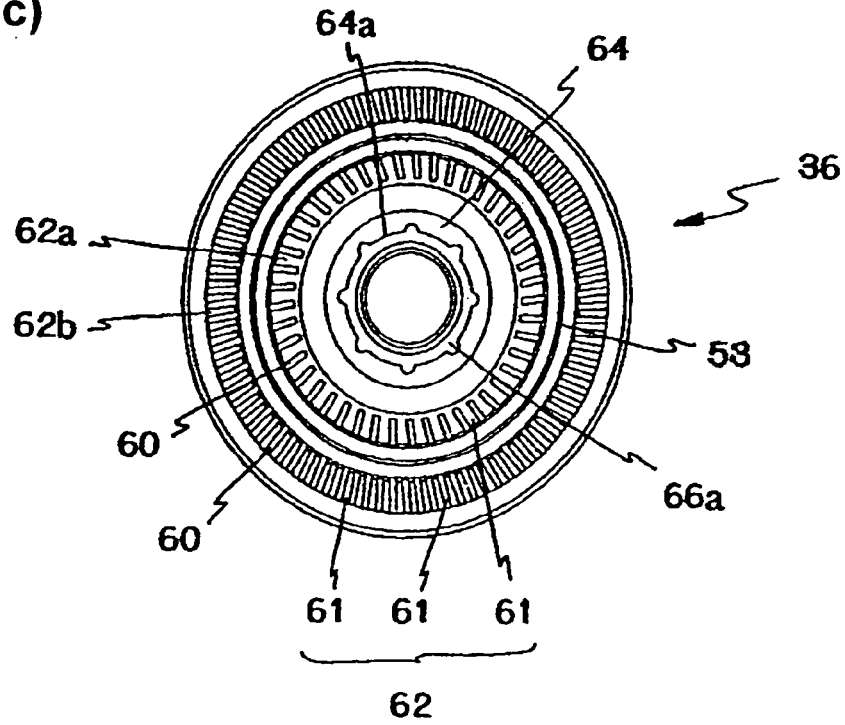

As seen from FIGS. 1 and 3(*a*) through 3(*c*), each outer cutter 36 of the shown embodiment of the present invention is formed in a cylindrical cup shape that opens at the bottom. The outer surface of the outer cutter 36 is a shaving surface 56 that contacts the skin during shaving. This shaving surface 56 is formed in the form of a ring when viewed from the top as shown in FIG. 3(*a*), and a recessed portion 64 is provided in the region surrounded by this ring-form shaving surface 56.

A demarcating groove 58 is formed in the shaving surface 56. This demarcating groove 58 takes a circular shape that is concentric with the ring-shaped shaving surface 56 and demarcates the shaving surface 56 into two concentric shaving surfaces 56*a* and 56*b*. Each of these demarcated shaving surfaces 56*a* and 56*b* is disposed in the form of a ring. Slits 60 are formed in these shaving surfaces 56*a* and 56*b* as openings into which hair is introduced. The slits 60 are opened radially so that the slits 60 extend in the direction of diameter of the outer cutter 36 from the center of the shaving surface 56.

As seen from FIG. 3(*c*), a plurality of outer cutter surface sections 61 (on portions of which cutter surfaces are formed) are formed on the inner surfaces of ribs that are formed by the slits 60. The aggregates of these outer cutter surface sections 61 are formed as outer cutter surfaces 62*a* and 62*b* on the other sides (the inner surface side of the outer cutter) of the shaving surfaces 56*a* and 56*b*.

As seen from FIG. 1, an engaging hole 64*a* is formed in the recessed portion 64 of the outer cutter 36; and an outer cutter cover 66 is, with its engaging part 66*a* formed in its bottom portion, inserted into the engaging hole 64*a*. The bottom surface of the outer cutter cover 66 is formed flat.

The inner cutter supporting body 40 is located beneath the outer cutter cover 66. The inner cutter supporting body 40 has a projecting portion 40*a* on its upper portion, and a recess 40*b* is formed in the inner cutter supporting body 40 so as to face the inner cutter drive shaft 24. As described above, the engagement tip end 24*b* of the inner cutter drive shaft 24 is inserted into the recess 40*b* of the inner cutter supporting body 40. The upper end surface of the projecting portion 40*a* of the inner cutter supporting body 40 and the lower end surface of the outer cutter cover 66 are spaced apart from each other.

Since the outer cutter cover 66 and the inner cutter supporting body 40 are disposed so as to have a space in between, no friction will occur between these elements. As a result, the power consumption of the shaver of the present invention is lower than that of a conventional electric shaver. Moreover, since there is no need to form the outer cutter cover 66 and inner cutter supporting body 40 with high precision, manufacture of the shaver is easy.

The inner cutter 38 that is attached to the inner cutter supporting body 40 is comprised of a disk part 72, a plurality of inner cutter arms 74 and inner cutter bodies 78. The disk part 72 has an engaging hole 72*a* at the center, and the inner cutter arms 74 are formed so as to protrude in an upright attitude from the outer circumferential edge of the disk part 72. The inner cutter bodies 78 are provided on the outside surfaces of the respective inner cutter arms 74, and they have inner cutter surfaces 76 formed on their tip end surfaces. The inner cutter 38 is supported on the inner cutter supporting body 40 with the engaging hole 72*a* of the disk part 72 being fitted over the projecting portion 40*a* of the inner cutter supporting body 40.

In the electric shaver of the shown embodiment, the inner cutter surfaces 76 at the tip end surfaces of the cutter bodies 78 of each inner cutter 38 are formed as convex surfaces that protrude outward (upward in FIG. 1), and the outer cutter surfaces 62 of the outer cutter 36 are formed as concave surfaces that receive therein the convex inner cutter surfaces 76. In other words, as best seen from FIG. 4, the cross-sectional shape of each inner cutter surface 76 (76*a*, 76*b*) has a convex shape that protrudes outward (or upward), and the cross-sectional shape of each outer cutter surface 62 takes a concave shape, so that the inner cutter surfaces 76 slide with respect to and inside of the concave outer cutter surfaces 62. The term "outward" refers to the direction oriented toward the outer cutter side from the inner cutters, and the term "cross-sectional shape" refers to the shape seen in cross section in the direction of diameter of the outer cutter surfaces 62 that is formed in a ring shape.

Figure 4:
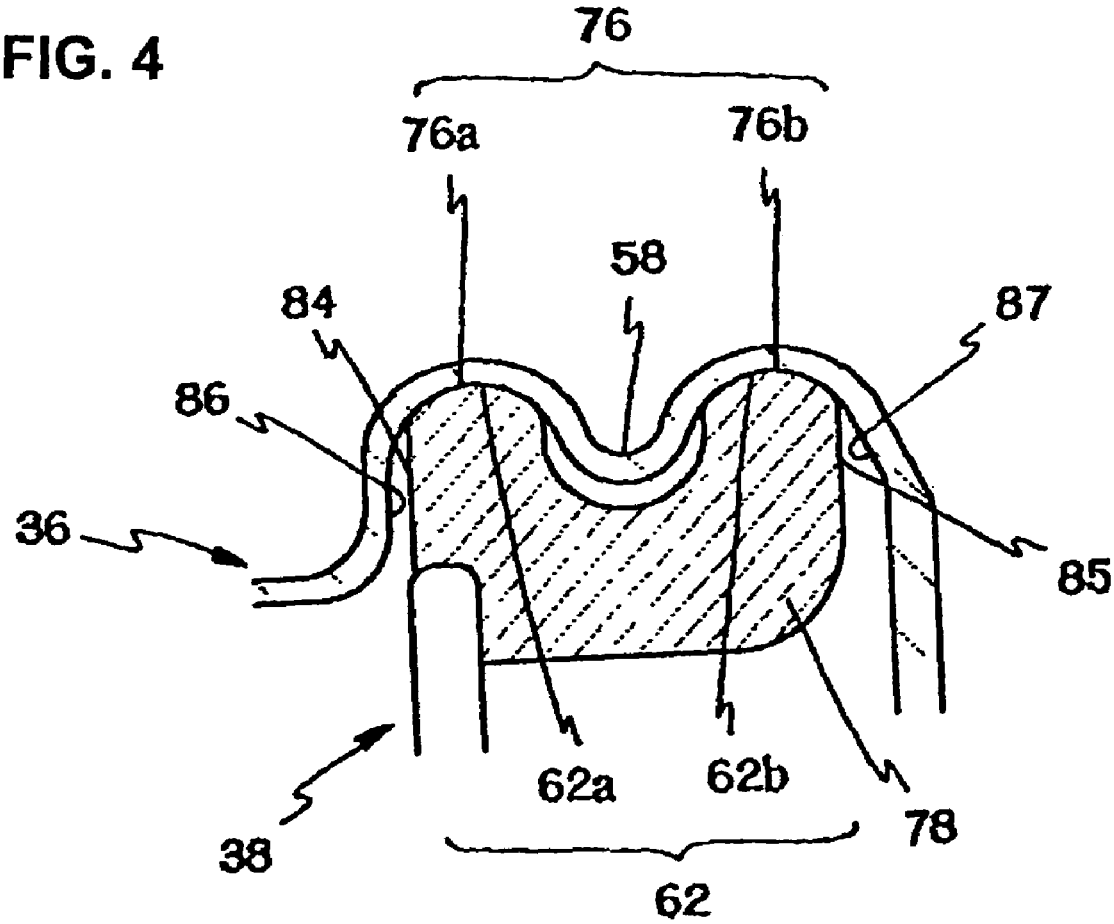
FIG. 4 shows the sliding contact between the outer cutter surface and the inner cutter surface in the structure of FIG. 1.

More specifically, as seen from FIG. 4, in which the inner cutter surfaces 76 are in sliding contact with the outer cutter surfaces 62, the tip end of each inner cutter body 78 of the inner cutter 38 is bifurcated. The respective inner cutter surfaces 76*a* and 76*b* formed on the tip end surfaces of the bifurcated inner cutter body 78 are formed as convex curved surfaces that protrude outward (or upward in FIG. 4).

On the other hand, outer cutter surfaces 62*a* and 62*b* that receive and make an engagement with the respective inner cutter surfaces 76*a* and 76*b* of the inner cutter 38 are formed on each outer cutter 36, and the outer cutter surfaces 62*a* and 62*b* are formed as concave surfaces.

As seen from the above, since the inner cutter surfaces 76*a* and 76*b* of the inner cutter 38 have a convex shape and contact the concave outer cutter surfaces 62*a* and 62*b* of the outer cutter 36, and the inner cutter 38 is rotated with its inner cutter surfaces 76*a* and 76*b* being constantly urged outward (or toward the outer cutter 36), the center positions of the inner cutter surfaces 76*a* and 76*b* and the center positions of the outer cutter surfaces 62*a* and 62*b* are prevented from making lateral positional deviations and they constantly produce forces that keep the convex inner cutter surfaces 76*a* and 76*b* to be engaged with the concave outer cutter surfaces 62*a* and 62*b*, so that the inner cutter 38 rotates without accompanying any axial deviation with respect to the outer cutter 36. In the above embodiment, the outer cutter surfaces 62 and the inner cutter surfaces 76 are formed in a bifurcated shape. Thus, the outer cutters surfaces 62 and the inner cutter surfaces 76 are more snugly engaged with each other than in a case of a so-called single-track cutter in which demarcating grooves are not formed and the outer cutter surfaces 62 and the inner cutter surfaces 76 are not bifurcated. In an electric shaver in which the outer cutter surfaces and inner cutter surfaces are thus formed to have a plurality of tracks, the axial deviation of the inner cutters with respect to the outer cutters can be prevented better.

In the electric shaver of the above embodiment, the outer cutters 36 and inner cutters 38 are disposed so that these cutters are spaced apart from each other except for the sliding contact portions of the outer cutter surfaces 62 of the outer cutters 36 and the inner cutter surfaces 76 of the inner cutters 38. More specifically, as seen from FIG. 1, each inner cutter supporting body 40 and the corresponding outer cutter central part on which the outer cutter cover 66 is disposed are spaced apart from each other, and as seen from FIG. 4, the inside surface 86 on the inner circumferential side of the outer cutter 36 and the inside surface 84 of each inner cutter body 78 are spaced apart from each other, and the inside surface 87 on the outer circumferential side of the outer cutter 36 and the outside surface 85 of the cutter body 78 are spaced apart from each other as well.

Accordingly, the outer cutters 36 and inner cutters 38 are disposed so that only the outer cutter surfaces 62 of the outer cutters 36 and the inner cutter surfaces 76 of the inner cutters 38 are in contact (sliding contact) with each other. As a result, since no friction generates by other portions, the power consumption of the electric shaver is reduced compared to that of conventional electric shavers.

The shapes of the inner cutter surfaces and outer cutter surfaces in the electric shaver of the present invention are not limited to those described above.

Figure 5A:
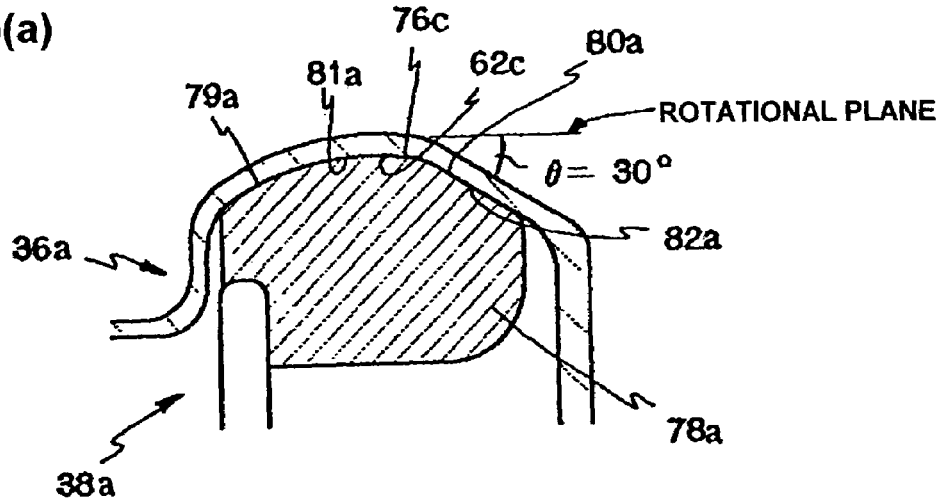
FIG. 5(*a*) and 5(*b*) respectively show another structure of the outer cutter surface and inner cutter surface of the present invention.
Figure 5B:
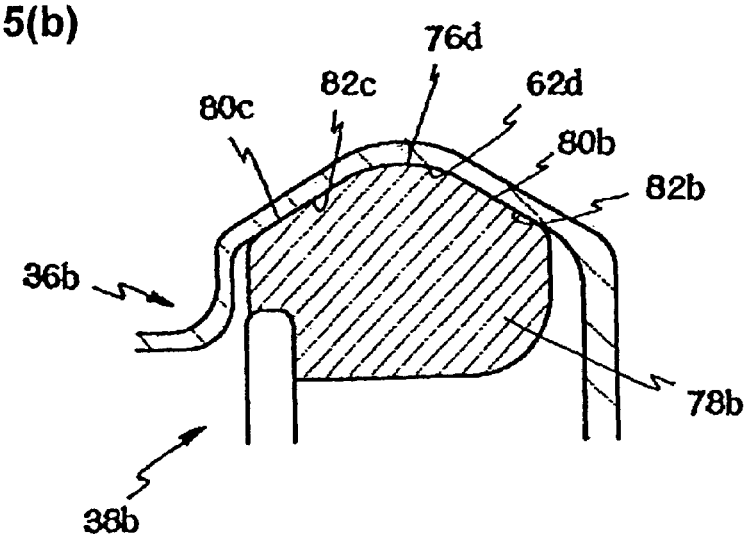
Figure 6:
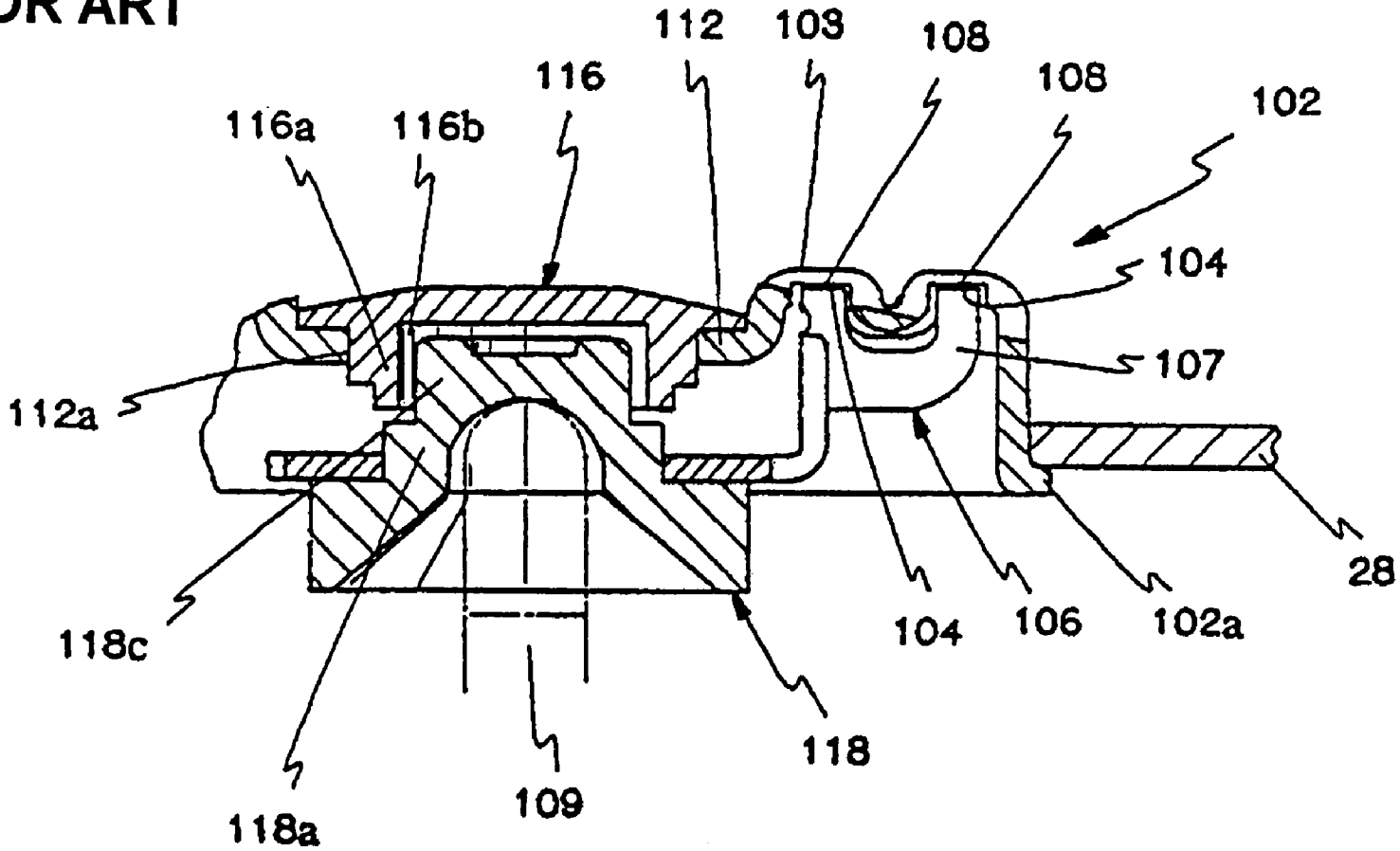
FIG. 6 PRIOR ART
FIG. 6 shows the main portion of the outer and inner cutter structure of a conventional electric shaver.
Figure 7:
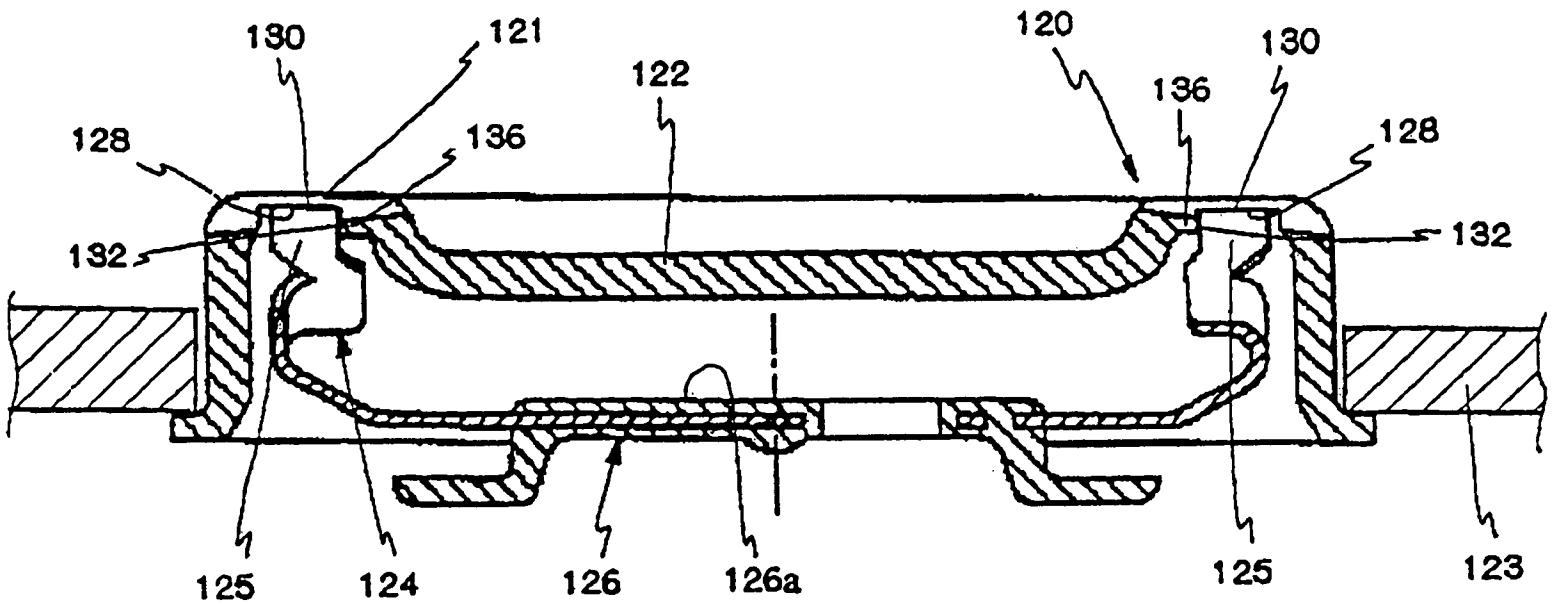
FIG. 7 PRIOR ART
FIG. 7 shows the outer and inner cutter structure of another conventional electric shaver.

More specifically, in FIG. 5(*a*), the outer cutter 36*a* of a single-track cutter in which no demarcating grooves are formed and the cutter body 78*a* of an inner cutter 38*a* are shown. The cutter body 78*a* is formed in a curved convex shape so that the tip end protrudes outward (or upward in FIG. 5(*a*)) and is formed also so that part of the tip end is cut away.

In other words, the inner cutter surface 76*c* of the tip end of the cutter body 78*a* has an inner cutter curved surface 79*a* and an inner cutter guide surface 80*a*. The cross-sectional shape of the inner cutter curved surface 79*a* in the direction of diameter is a curved shape that protrudes outward, and the cross-sectional shape of the inner cutter guide surface 80*a* in the direction of diameter is a rectilinear shape. The rectilinear inner cutter guide surface 80*a* is positioned on the outer circumferential side of the ring-form outer cutter surface 62*c* of the outer cutter 36*a* that is in contact with the cutter body 78*a*. Also, this rectilinear inner cutter guide surface 80*a* is disposed so that its angle of inclination θ with respect to the rotational plane of the inner cutter 38 is approximately 30° (In FIG. 5(*a*) this angle of inclination θ is shown using the outside surface of the outer cutter guide surface 82*a* (described below) that is parallel to the rectilinear outer cutter guide surface 82*a* and to the rectilinear inner cutter guide surface 80*a*).

The outer cutter surface 62*c* of the outer cutter 36*a* comprises an outer cutter curved surface 81*a*, whose cross-sectional shape in the direction of diameter is a curved shape, and an outer cutter guide surface 82*a*, whose cross-sectional shape in the direction of diameter is a rectilinear shape. This outer cutter guide surface 82*a* is a portion where the outer circumferential side of the outer cutter surface 62*c* is formed in a frustum shape.

Thus, when the inner cutter 38*a* is rotationally driven, the inner cutter guide surface 80*a* of the cutter body 78*a* makes sliding contact with the outer cutter guide surface 82*a* of the outer cutter 36*a*.

Thus, since the inner cutter guide surface 80*a* of the inner cutter 38*a* is in a rectilinear shape, even if a slight shaking is generated in the rotating cutter body 78*a* of the inner cutter 38*a*, the inner cutter guide surface 80*a* that is inclined in a rectilinear shape is regulated by the outer cutter guide surface 82*a* of the outer cutter 36*a*, so that the rotational track of the cutter body 78*a* is stabilized, preventing axial deviation of the inner cutter 38*a*.

If the angle of inclination θ of the outer cutter guide surfaces 82*a* is too small, the effect of the outer cutter guide surfaces 82*a* in preventing the axial deviation would be insufficient. Accordingly, it is advisable that the angle of inclination of the outer cutter guide surfaces 82*a* be set so that $\theta>30°$. In order to achieve a guiding action, the angle of inclination of the outer cutter guide surfaces 82*a* is set so that $\theta<90°$; however, if the angle of inclination θ is too large, the degree of engagement will become deep, increasing the friction between the inner and outer cutters. Accordingly, it is not desirable to set the angle of inclination θ at an excessively large value.

In FIG. 5(*b*) that shows another example, outer cutter guide surfaces 82*b* and 82*c* are formed on the outer circumferential side and inner circumferential side of the outer cutter surface 62*d* of the outer cutter 36*b*, and these outer cutter guide surfaces 82*b* and 82*c* are formed rectilinear. With these rectilinear outer cutter guide surfaces 82*b* and 82*c*, the central portion of the outer cutter 36*b* has a curved surface 62*d* that protrudes outward, and the rectilinear outer cutter guide surfaces 82*b* and 82*c* are on both sides of the curved surface of the outer cutter 36*b*. Inner cutter guide surfaces 80*b* and 80*c* which are rectilinear and inclined in the same manner as the outer cutter guide surfaces 82*b* and 82*c* of the outer cutter 36*b* are formed on the inner cutter surface 76*d* of the cutter body 78*b* so as to engage with the outer cutter guide surfaces 82*b* and 82*c*. As a result, the inner cutter 38*b* is guided by the outer cutter guide surfaces 82*b* and 82*c* of the outer cutter 36*b* with axial deviation being prevented.

The electric shaver of the present invention is not limited to those that have the structures described above. For example, in the shown embodiment, the cutter frame 28 is detachably attached to the electric shaver main body 12; however, the cutter frame can be integral to the main body. Furthermore, the electric shaver of the shown embodiments has, as can be seen from FIG. 2, three shaving units 30; however, in the present invention, the shaver can have a single shaving unit 30, or it can have two or more than three shaving units.

In the present invention, the openings into which hair is introduced are not limited to slits. Instead, holes can be formed in the outer cutter(s).

In regard to the shape of the outer cutter(s) as well, a plurality of demarcating grooves can be formed therein, so that two or more concentric shaving surfaces are provided. In this case, the tip end of each one of the cutter bodies is formed with the same number of branches as the outer cutter surfaces so as to ensure sliding contact with the respective outer cutter surfaces.

In the shown embodiment, the outer cutter cover is tilted in the central portion of each outer cutter; however, the outer cutter cover can be formed integral to outer cutter.

Furthermore, the tilting mechanism of the shaving units is likewise not limited to the tilting mechanism used in the shown embodiments; and the present invention is applicable to shavers that have mechanism which allows the outer cutters and inner cutters to tilt in any manner with respect to the cutter frame 28.

As described in detail in the above, according to the present invention, an outer cutter and inner cutter are disposed so that these cutters can tilt, the inner cutter surface of the inner cutter has a convex shape that protrudes outward, the outer cutter surface of the outer cutter has a concave shape that receives the convex inner cutter surface, and the inner cutter surface and outer cutter surface are positionally aligned so that these cutter surfaces are engaged with each other. Accordingly, the inner cutter rotates without accompanying any axial deviation with respect to the outer cutter. Furthermore, when the outer cutter tilts, the inner cutter tilts also in conformity with the outer cutter; and the tilted inner cutter rotates with no axial deviation with respect to the outer cutter.

Since the outer cutter and inner cutter are formed so that only the outer cutter surface and inner cutter surface make a contact with each other, various conspicuous merits such as a reduction in power consumption, etc. compared to conventional electric shavers are realized.

What is claimed is:

1. An electric shaver comprising:

an outer cutter in which a shaving surface that contacts the skin is formed in a ring shape and an inside surface of said shaving surface is formed as an outer cutter surface, and an inner cutter in which a portion that makes sliding contact with said outer cutter surfaces formed as an inner cutter surface, said inner cutter surface being connected to an inner cutter drive shaft so as to be rotated, wherein said outer cutter and said inner cutter be tiltably disposed with respect to a cutter frame that is disposed on an electric shaver main body;

said inner cutter surface is formed as a convex curved surface that protrudes towards said outer cutter side, said outer cutter surface is formed as a concave curved surface that receives said convex curved surface of said inner cutter surface, and said convex inner cutter surface and said concave outer cutter surface are in an engagement with each other so as to prevent axial deviation of said inner cutter; and said outer cutter surface is formed, on at least a part thereof, with an outer cutter guide surface whose shape in cross section in a direction of diameter of said outer cutter is rectilinear, and said inner cutter surface is formed with an inner cutter guide surface which makes sliding contact with said outer cutter guide surface.

2. The electric shaver according to claim 1, wherein said outer cutter end said inner cutter are disposed so that said outer and inner cutters are spaced apart from each other except for sliding contact portions of said outer cutter surface and said inner cutter surface.

3. The electric shaver according to claim 1, wherein said outer cutter surface is formed, on at least a part thereof, with an outer cutter guide surface whose shape in cross section in a direction of diameter of said outer cutter is rectilinear, and said inner cutter surface is formed with an inner cutter guide surface which makes sliding contact with said outer cutter guide surface.

4. The electric shaver according to claim 1, wherein said outer cutter guide surface has an angle of inclination θ which is substantially 30°<θ90° with respect to a plane of rotation of said inner cutter.

5. An electric shaver comprising:

an outer cutter in which a shaving surface that contacts the skin is formed in a ring shape an inside surface of said shaving surface is formed is formed as an outer cutter surface, and an inner cutter in which a portion that makes sliding contact with said outer cutter surface is formed as an inner cutter surface, said inner cutter being connected to an inner cutter drive shaft so as to be rotated, wherein said outer cutter and said inner cutter being tiltably disposed with respect to a cutter frame that is disposed on electric shaver main body;

said inner cutter surface is formed as a convex curved surface that protrudes towards said outer cutter side, said outer cutter surface is formed as a concave curved surface that receives said convex curved surface of said inner cutter surface, and said convex inner cutter surface and said concave outer cutter surface are in engagement with each other so as to prevent axial deviation of said inner cutter; and one or more concentric circular demarcating grooves are formed in said outer cutter, and said inner cutter surface is formed in a shape that engages with said outer cutter surface demarcated by said demarcating grooves.

6. The electric shaver according to claim 3, wherein one or more concentric circular demarcating grooves are formed in said outer cutter, and said inner cutter surface is formed in a shape that engages with said outer cutter surface demarcated by said demarcating grooves.

7. The electric shaver according to claim 1, wherein one or more concentric circular demarcating grooves are formed in said outer cutter, and said inner cutter surface is formed in a shape that engages with said outer cutter surface demarcated by said demarcating grooves.

8. The electric shaver according to claim 4, wherein one or more concentric circular demarcating grooves are formed in said outer cutter, and said inner cutter surface is formed in a shape that engages with said outer cutter surface demarcated by said demarcating grooves.

* * * * *